US007210684B2

(12) United States Patent
Yuan

(10) Patent No.: US 7,210,684 B2
(45) Date of Patent: May 1, 2007

(54) CASINO CARD GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 638 days.

(21) Appl. No.: 10/822,018

(22) Filed: Apr. 8, 2004

(65) Prior Publication Data

US 2004/0262843 A1 Dec. 30, 2004

Related U.S. Application Data

(63) Continuation-in-part of application No. 10/376,223, filed on Feb. 27, 2003, now Pat. No. 7,032,902.

(51) Int. Cl.
*A63F 3/00* (2006.01)

(52) U.S. Cl. ..... 273/292; 273/274

(58) Field of Classification Search ..... 273/292, 273/274, 309

See application file for complete search history.

(56) References Cited

U.S. PATENT DOCUMENTS 5,257,810 A * 11/1993 Schorr et al. ..... 273/292
5,362,064 A * 11/1994 Lofink et al. ..... 273/292
5,377,993 A * 1/1995 Josephs ..... 463/12
5,685,774 A * 11/1997 Webb ..... 463/13
5,743,560 A * 4/1998 Jackson et al. ..... 280/741
5,810,663 A * 9/1998 Bochichio et al. ..... 463/13
5,820,128 A * 10/1998 Brunelle ..... 273/292
5,851,011 A * 12/1998 Lott ..... 273/292
5,863,042 A * 1/1999 Lo ..... 273/292
5,873,571 A * 2/1999 Vaisman et al. ..... 273/292
5,876,283 A * 3/1999 Parra et al. ..... 463/12
5,988,643 A * 11/1999 Awada ..... 273/292
6,065,753 A * 5/2000 Morosky ..... 273/292
6,070,876 A * 6/2000 Ko ..... 273/293
6,270,078 B1 * 8/2001 Leone et al. ..... 273/292
6,279,910 B1 * 8/2001 de Keller ..... 273/292
6,371,484 B1 * 4/2002 Yuan ..... 273/292
7,032,902 B1 * 4/2006 Yuan ..... 273/274

* cited by examiner

*Primary Examiner*—William M. Pierce
(74) *Attorney, Agent, or Firm*—Robert Ryan Morishita; Morishita Law Firm, LLC

(57) ABSTRACT

A player places a full-hand wager on a first hand or a second hand, a component-hand wager on one or both component hands of a first hand, or a full-hand wager and a component-hand wager. A first hand and a second hand, each with three cards, are dealt. Optionally, the hands are examined for a predetermined three-card combination, the hand with the higher ranking three-card combination automatically wins. Each hand is arranged into a two-card component hand and a single-card component hand. Component-hand wagers are won by players wagering on higher ranking component hands. Full-hand wagers are won by players wagering on the hand with one component hand outranking the corresponding component hand of the other hand and the remaining component hand outranking or tying the corresponding component hand of the other hand.

5 Claims, 5 Drawing Sheets

CASINO CARD GAME

RELATED APPLICATION DATA

The present application is a continuation-in-part of U.S. application Ser. No. 10/376,223, entitled "Casino Card Game," filed Feb. 27, 2003 now U.S. Pat. No. 7,032,902 by Applicant herein.

FIELD OF THE INVENTION

The present invention relates to casino card games. Specifically, the present invention is a card game in which a player wagers on one of two hands and is rewarded if, upon comparison, the player has wagered on the higher ranking hand.

BACKGROUND OF THE INVENTION

Card games such as Pai Gow Poker and Baccarat are well known forms of casino-type games. Specifically, these games are attractive to players because these games give the player a reasonable chance of winning their wager. Moreover, these games provide the casinos with a reasonable return for hosting the game.

Baccarat is a live table game that uses a standard deck of fifty-two playing cards. The object of the game of Baccarat is for the bettor to successfully wager on whether the Bank's hand or the Player's hand is going to win. The bettor receives even money for his wager if he selects the winning hand and loses his wager if he selects the losing hand. Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten. The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero. Whichever of the Bank hand or the Player hand is closest to a total of nine is the winner.

Depending on the point total of the initial Player's hand and the initial Dealer's hand, one more card may be dealt to either the Player's hand, the Dealer's hand or both. The rules for determining whether a third card is dealt are fixed; that is, there is no discretion for either the Player's hand or the Dealer's hand on whether a third card is dealt.

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total: | Bank hand DRAWS when the Player's hand third card is: | Bank hand STANDS when the Player's hand third card is: |
|---|---|---|
| 0, 1, or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

At the end of each hand, winning wagers are paid and losing wagers are collected by the house. Any commission due to the house is marked in commission boxes in the center of the table.

One drawback of Baccarat is that the draw rules are complicated. Moreover, Baccarat is an unfamiliar game to most bettors. Thus, some players are intimidated from playing.

In Pai Gow Poker, seven cards are dealt to the banker and the players. The banker and players arrange the cards into a five-card high hand and a two-card low hand. Each player compares his or her high hand to the banker's high hand and his or her low hand to the banker's low hand. The player wins if both hands outrank the corresponding banker's hands according to conventional poker rankings. If one of the player's hands outranks one of the banker's hands, and the other banker's hand ties or outranks the other player hand, the player and banker "push" and the player neither wins nor loses his wager. If both the banker's hands outrank or tie the player's hands, the player loses his or her wager.

It can be seen that Pai Gow Poker lacks complicated draw rules; the player uses the cards he or she is dealt. Also, the comparison of hands in Pai Gow Poker is still fairly complicated and can be difficult to apply unless the player is familiar with conventional Poker rankings.

Thus, it can be seen that there is a need in the art for a casino card game that is simpler than prior art casino card games yet provides the player with a reasonable chance of winning.

SUMMARY OF THE INVENTION

A casino card game between a casino and at least one player using at least one deck of fifty-two cards begins with the player placing (a) a full-hand wager on either a first hand or a second hand or (b) a component-hand wager on a single-card component hand of the first hand, the two-card component hand of the first hand, or both component hands of the first hand or (c) both a full-hand wager and a component-hand wager. A dealer deals three cards to a first hand and three cards to a second hand.

In an optional embodiment, the first hand and second hand are examined. If either hand has a predetermined three-card combination, optionally a three of a kind, the first hand is compared to the second hand. The winning hand is the hand with the higher ranking three-card combination. If both hands have three-card combinations of equal rank, a push is declared and the player's wagers are returned.

If neither hand has the predetermined three-card combination, or in an optional embodiment in which the hands are not examined for a three-card combination, the hands are arranged into a two-card component hand and a single-card component hand. The component hands of the first hand are compared to the corresponding component hands of the second hands. Component-hand wager are resolved by rewarding players placing a component-hand wager on a single-card component hand if the single-card component hand of the first hand outranks the single-card component hand of the second hand. Similarly, players placing a component-hand wager on a two-card component hand are rewarded if the two-card component hand of the first hand outranks the two-card component hand of the second hand. Ties could result in a player win or loss as elected by the game operator.

Turning to the fill-hand wagers, a push occurs when the first two-card hand is equal in rank to the second two-card hand and the first single-card hand is equal in rank to the second single-card hand or if one component hand of the first hand outranks the corresponding component hand of the second hand and the other component hand of the second hand outranks the corresponding component hand of the first hand. Otherwise, the winning hand is the hand with one component hand outranking the corresponding component hand of the other hand and the remaining component hand outranking or tying the corresponding component hand of the other hand. Players placing a full-hand wager on the winning hand are rewarded. Optionally, the casino retains a commission on all winning wagers.

In a second aspect of the present game, each player wagers on his or her own hand rather than communal hands. Play is otherwise as described above.

DESCRIPTION

Figure 1:
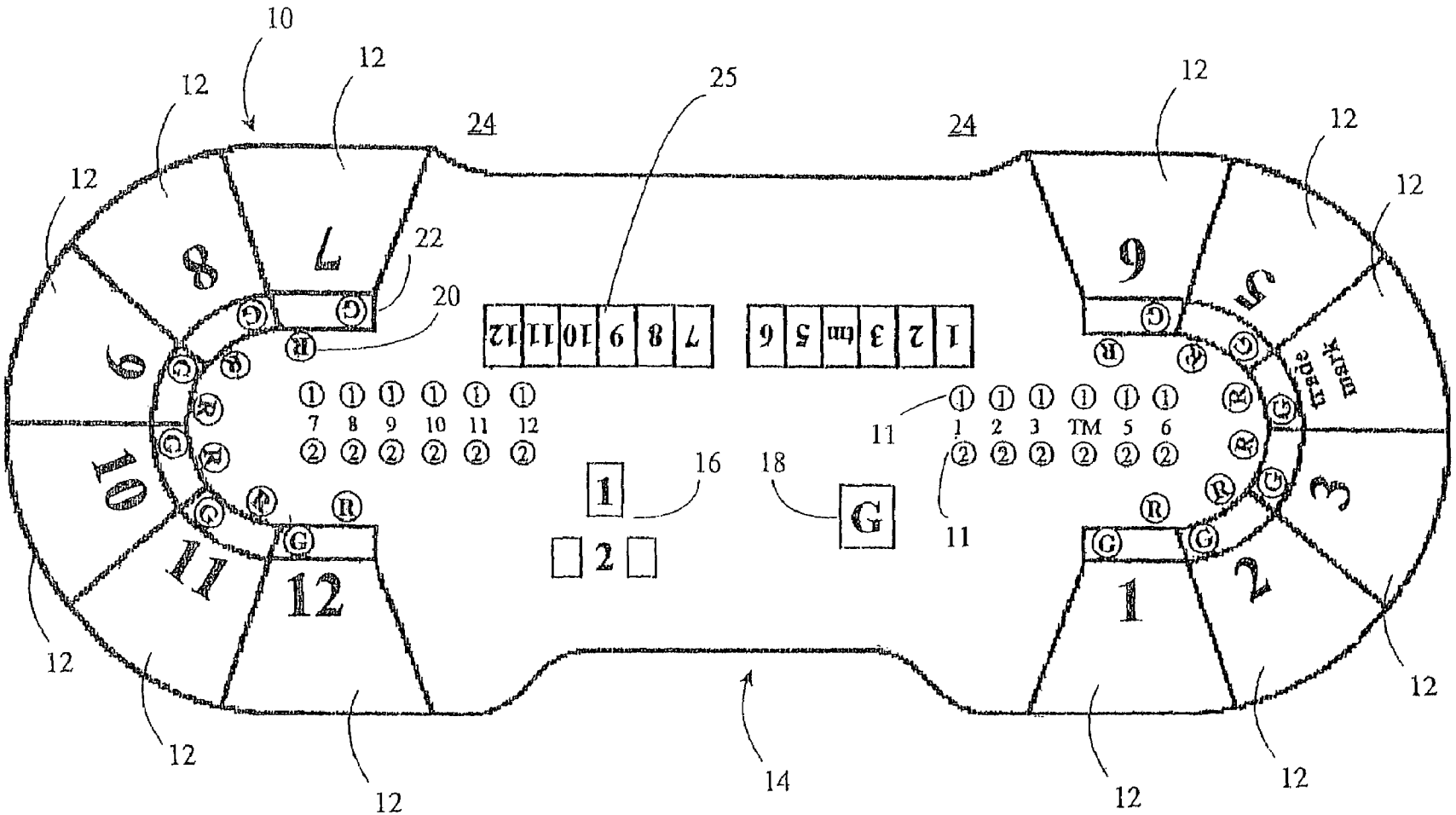
FIG. 1 is a top view of the table layout used for a game method according to an embodiment of the present invention.
Figure 2:
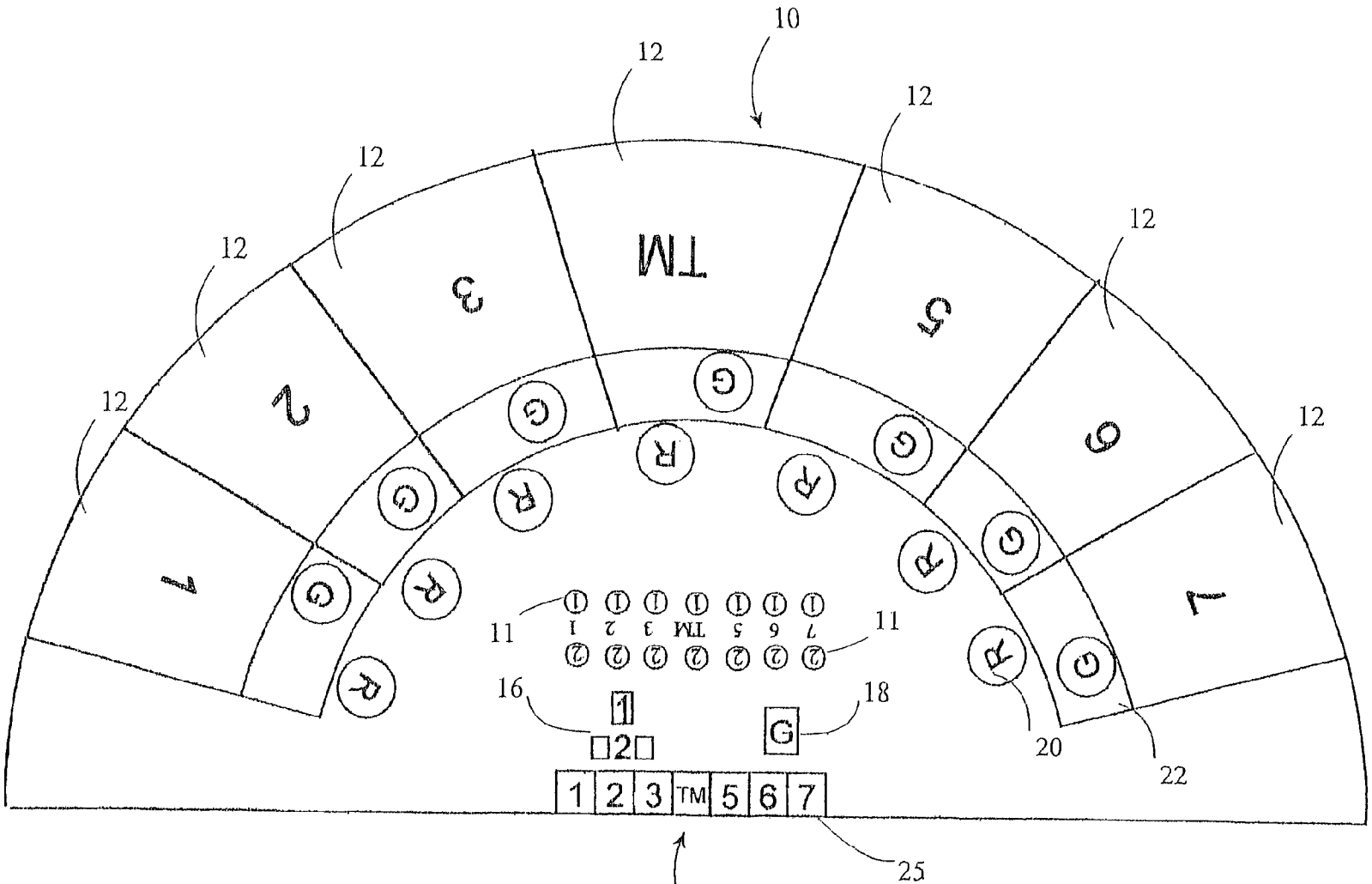
FIG. 2 is a top view of the table layout used for a game method according to an alternate embodiment of the present invention.

Reference is now made to the figures wherein like parts are referred to by like numerals throughout. With reference to FIGS. 1 and 2, the game of the present invention is played on a table layout 10 including player areas 12 and dealer areas 14. The layout 10 additionally includes areas for a first hand 16, referred to in the example below as the "Red" hand 16, and a second hand 18, referred to in the example below as the "Green" hand 18. The player areas 12 include a plurality of "Red" hand betting areas 20 and a plurality of "Green" hand betting areas 22. The layout further includes betting areas 11 for wagering on either component hand of one of the "Red" or "Green" hands. In the optional layout 10 of FIGS. 1 and 2, the component-hand wagering areas 11 are placed on the "Red" hand, although it is contemplated that the wagers could be placed on the "Green" hand. The layout 10 of FIG. 1 is has three areas for employees, a dealer area 14 for a dealer who deals cards and two croupier areas 24 for croupiers who pay and collect wagers. By contrast, the layout 10 of FIG. 2 has a single dealer area for a dealer who performs all tasks.

Figure 3:
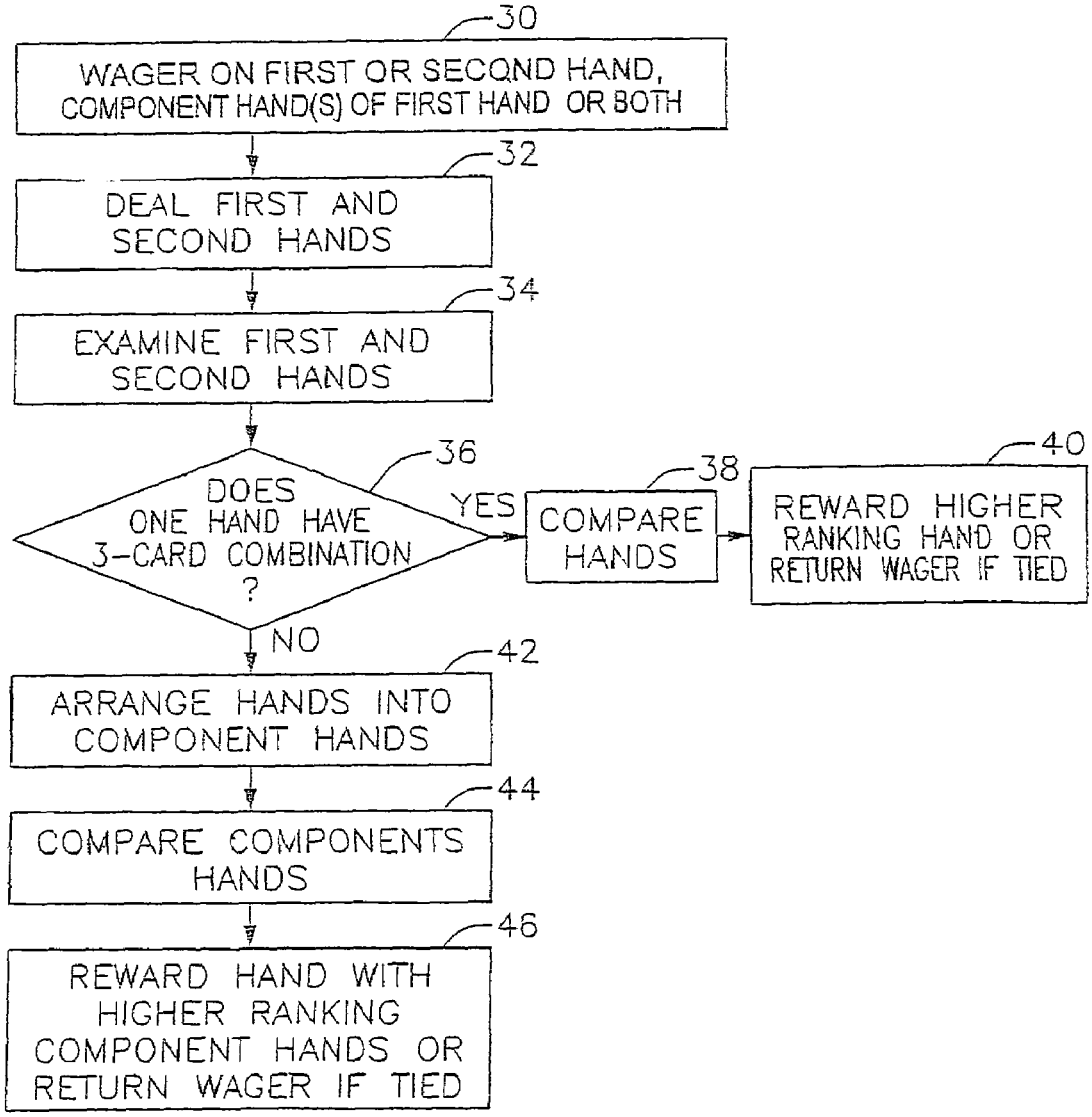
FIG. 3 is a flow chart of a game method according to an embodiment of the present invention.

With reference to FIG. 3, the game of the present invention requires at least one dealer and at least one player. The game of the present invention is played using playing cards, optionally, in the form of one or more conventional decks of fifty-two playing cards. Optionally, a plurality of decks, such as seven, may be used in conjunction with a card shoe. After the cards are randomized, such as through shuffling and cutting, the players place their wagers 30. In a first aspect of the present game, shown in FIG. 3, players wager on communal hands, either the first hand, or "Green" hand, or the second hand, or "Red" hand. In a second aspect of the present game, shown in FIG. 4 and described hereinafter, each player is dealt 50 and wagers on 48 his or her own hand. Wagers available to players include: (a) a full-hand wager on a first hand or a second hand and (b) a component-hand wager on a single-card component hand of the first hand, a two-card component hand of the first hand, or both a single-card component hand and two-card component hand of the first hand. It is contemplated that a player may be permitted to place both a full-hand wager and a component-hand wager as described above. That is, a player may place a full-hand wager on the first hand as a whole as well as component-hand wagers on the component hands of the first hand.

Referring to FIG. 3, in one embodiment of the present invention, the dealer deals 32 a three card "Red" hand and a three card "Green" hand and places them face up on the layout 10 at the "Red" hand area and the "Green" hand area. In an alternate embodiment, the dealer may deal three cards face down to the "Red" hand area and three cards face down at the "Green" hand area. The dealer may then build suspense by passing two cards from the "Green" hand to the highest "Green" hand bettor to expose before the dealer exposes the final card of the "Green" hand. Alternatively or additionally, the dealer may do likewise with the "Red" hand.

Once the "Green" hand and "Red" hand are exposed, the dealer, in an optional embodiment, may examine 34 each hand to determine 36 whether either hand has a predetermined three-card combination, such as a three of a kind. If only one hand has the three-card combination, that hand is the winner 40. For example, if the "Red" hand is 4♢ 4♡ 4♤and the "Green" hand is 3♡ 10♡ K♤, the "Red" hand is the winner. All players wagering on the "Red" hand are rewarded 40. Wagers placed on the "Green" hand are collected. Optionally, the house may collect a commission, such as 5%, for all winning wagers. If both hands have the three-card combination, the hands are compared 38. The hand with the higher ranking combination is the winner 40. For example, if the "Red" hand is 5♧ 5♡ 5♤ and the "Green" hand is 8♧ 8♢ 8♡, the "Green" hand is the winner. Wagers are resolved as above. If a multi-deck shoe is used, it is possible that both hands have equal ranking three-card combinations. If this occurs, a push is declared and wagers are neither collected nor rewarded 40. Optionally, the house may implement a rule that aces are the lowest ranked card or that aces are lower than deuces but higher than any other card (i.e. A♡ A♢ A♤ beats 7♢ 7♤ 7♡ but loses to 2♢ 2♤2♡).

When one hand automatically wins in such a fashion, component-hand wagers are optionally rewarded if the hand wagered upon automatically wins. That is, if the component-hand wagers are placed on the "Red" hand and the "Red"

hand automatically wins by receiving a predetermined combination, component-hand wagers on the "Red" hand are rewarded.

If neither hand has the predetermined three-card combination, or in an optional embodiment in which the hands are not examined for a three-card combination, the dealer arranges 42 each hand into two component hands, a two-card component hand and a single-card component hand. The two-card component hand may also be referred to as the "high" hand and the single-card component hand may also be referred to as the "low" hand. The house may optionally institute a rule in which the high hand must outrank the low hand. Similarly, the house may optionally adopt house rules for how the dealer must arrange 42 the dealer's component hands. Specifically:

(1) Split pairs of aces, i.e. play one ace in each component hand, unless the third card is a King;

(2) Split pairs of Kings, i.e. play one King in each component hand, unless the third card is a Jack, Queen, or ace;

(3) Play all other pairs as the two-card component hand;

(4) If the hand has no pairs, play the higher, or second high, card as the single-card hand and the remaining cards as the two-card hand.

The "Red" high hand is compared 44 to the "Green" high hand and the "Red" low hand is compared to the "Green" low hand. While any ranking system could be used, for simplicity, the house may institute house rules that only two hands rank: a pair and card rank. In other words, the house may eliminate such hands as straight flush, flush, straight, and the like for the sake of simplicity and make a pair the higher ranking hand and the high card the next higher hand (like poker, if the higher ranking cards are tied, one looks to the next higher card, i.e. Q♡ 8♡ outranks Q♧ 3♧). In such an embodiment, for example, the "Red" high hand of 5♢ 5♧beats a "Green" high hand of Q♤ K♤. Likewise, a "Red" high hand of 4♡ 8♢ beats a "Green" high hand of 3♧ 6♧. As with above, the house may optionally implement a rule that aces are the lowest ranked card or that aces are lower than deuces but higher than any other card (i.e. A♡ A♢ A♤beats J♢ J♤ J♡ but loses to 2♢ 2♤ 2♡).

Component hand wagers are first resolved by rewarding players placing a component-hand wager on a single-card component hand if the single-card component hand of the hand wagered upon outranks the single-card component hand of the other hand and rewarding players placing a component-hand wager on a two-card component hand if the two-card component hand of the hand wagered upon outranks the two-card component hand of the other hand. For example, suppose a player places a component-hand wager on a "Red" low hand in a game in which the "Green" hand is 5♡ 5♢ and J♤ and the "Red" hand is 8♧ 3♢ and 4♡. The player's "Red" low hand wager is collected because the "Red" low hand of 4♡ is outranked by the "Green" low hand of J♤. Similarly, suppose a player places a component-hand wager on a "Red" low hand in a game in which the "Green" hand is 9♡ 7♢ and 8♤ and the "Red" hand is K♧ 3♢ and 4♡. A "Red" high hand wager is rewarded because the "Red" high hand of K♧ 3♢ outranks the "Green" high hand of 9♡ 7♢. Tied component hands could be treated as a player win, a player loss, or a push.

Turning now to the full-hand wagers, a hand is declared the winner 46 if the high hand and the low hand outrank the high hand and low hand of the other hand. For example, a "Green" hand of 7♡ 7♤ and K♢ wins over a "Red" hand of J♧ 8♢ and 9♡. Likewise, a hand is declared the winner if one of the component hands, either the high hand or the low hand, outrank the other hand's corresponding component hand and the remaining component hand ties the other hand's corresponding component hand. Thus, a "Red" hand of K♡ 5♧ and 7♤ wins over a "Green" hand of J♧ 2♢ and 7♡ or a "Green" hand of K♢ 5♢ and 6♡. A push is declared 46 if both the high and low component hands tie the counterpart component hands or if one "Red" component hand outranks the corresponding "Green" component hand while the remaining "Green" component hand outranks the remaining "Red" component hand. For example, 4♧ 4♡ and 7♢ ties 4♢ 4♤ and 7♡. Likewise, 5♡ 5♤ and 9♧ ties K♤ 4♢ and 10♡.

Full-hand wagers are resolved by rewarding 46 players wagering on the winning hand. Optionally, the wagers are rewarded at even money. Losing full-hand wagers are collected. In the event of a push 46, full-hand wagers are returned to the players. In an optional embodiment, a commission is charged by the house for winning wagers. With reference to FIGS. 1 and 2, the commission owed by each player may be tracked at a commission area.

Figure 4:
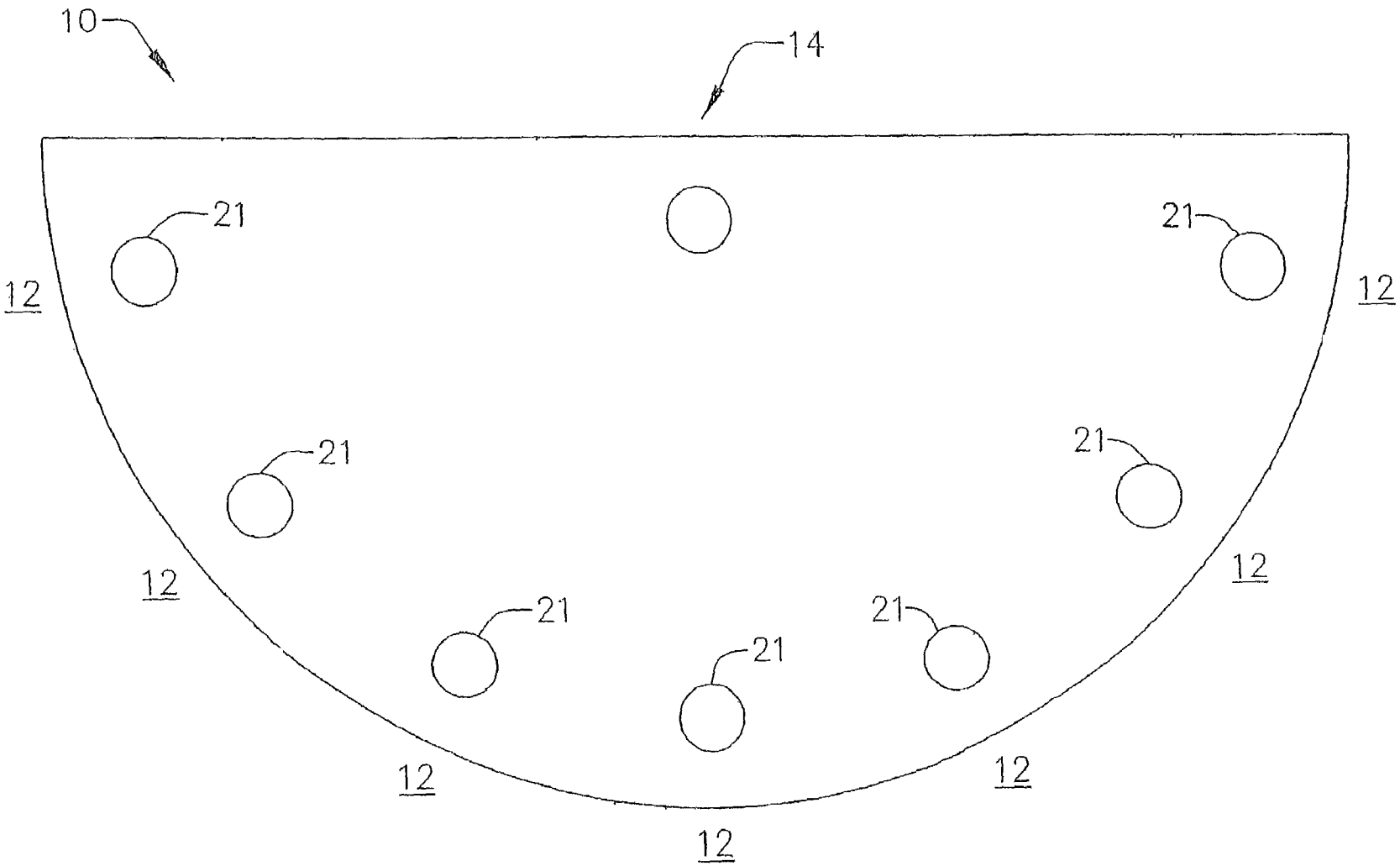
FIG. 4 is a top view of the table layout used for a game method according to an alternate embodiment of the present invention.
Figure 5:
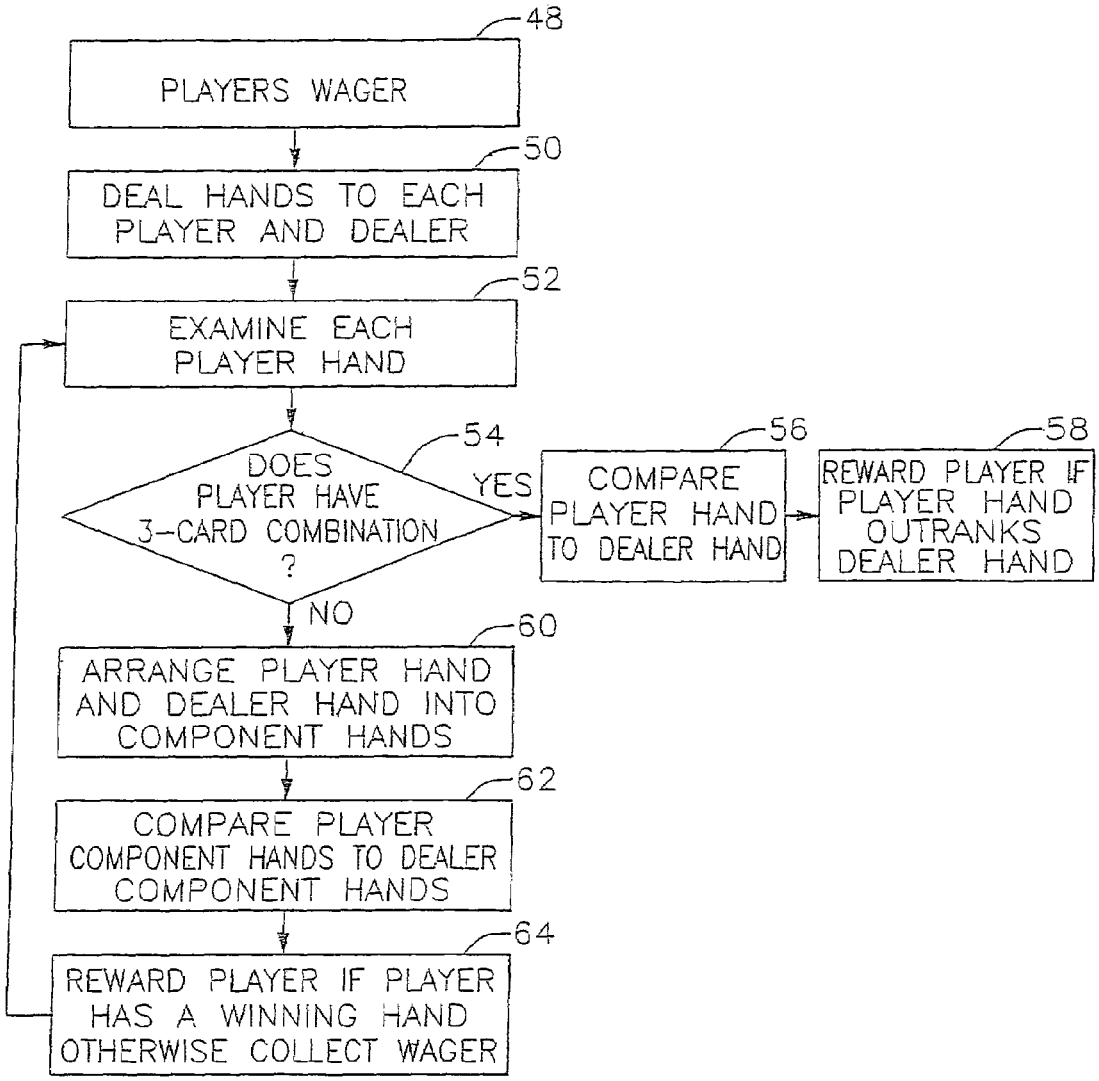
FIG. 5 is a flow chart of a game method according to an alternate embodiment of the present invention.

Referring to FIGS. 4 and 5, in a second aspect of the present invention, each player places a wager 48 at a player wagering area 21 on the table layout 10. The dealer deals three cards 50 to each wagering player and to the dealer at the player areas 12 and dealer area 14, respectively. In this aspect of the present invention, each player wagers on whether the player's hand will outrank the dealer's hand rather than on communal hands.

In an optional embodiment, each player hand may be serially examined 52 to determine 54 whether the player hand has a predetermined three-card combination, such as a three of a kind. Such a situation could be handled in many different ways. In one optional embodiment of the second aspect of the game, any player hand having three of a kind automatically wins, without regard to the dealer's hand, and is rewarded, optionally at greater than even money. In an alternate optional embodiment, any player hand having the three-card combination is the winner 58 unless, comparing 56 the player hand to the dealer hand, the dealer has a three-card combination outranking the player hand. For example, if the player hand is 4♢ 4♡ 4♤ and the dealer hand is 3♡ 10♡ K♧, the player hand is the winner. Conversely, if the player hand is 4♢ 4♡ 4♤ and the dealer hand is 7♧ 7♢ 7♡, the dealer hand wins. Wagers are paid 58 if the player has a winning hand or collected if the dealer has a winning hand. If a multi-deck shoe is used, it is possible that both hands have equal ranking three-card combinations. In the third aspect of the game, when this occurs, the player loses and wagers are collected. That is, players lose on ties when playing against the dealer.

In any of these options, the house may further optionally implement a rule that player's hands with three of a kind aces or Kings automatically win. Thus, a player hand K♢ K♡K♤ wins even if the dealer has A♢ A♡ A♤. Likewise, the house may implement a house rule that aces are lower than deuces but higher than any other card (i.e. A♡ A♢ A♤beats 7♢ 7♤ 7♡ but loses to 2♢ 2♤ 2♡). That is, three of a kind dueses may be the highest ranking three of a kind.

After resolving all player hands with three-card combinations, or in an embodiment in which the player hands are not examined for three-card combinations, the dealer arranges 60 the dealer hand into two component hands, a two-card high hand and a single-card low hand. Similarly, the remaining players each arrange 60 their hands into a two-card high hand and a single-card low hand. The house may optionally institute a rule in which the high hand must outrank the low hand. The dealer high hand is compared 62 to the each player high hand and the dealer low hand is compared to each player low hand. Again, any ranking system could be used. However, for simplicity, the ranking system that uses only pairs and card ranks as described above may optionally be used. As with above, the house may optionally implement a rule that aces are the lowest ranked card or that aces are lower than deuces but higher than any other card (i.e. A♡ A♢ A♤ beats 7♢ 7♤ 7♡ but loses to 2♢ 2♤ 2♡). Also, optionally, the dealer may win on ties. That is, if the player's high and low component hands tie 64 the dealer's counterpart component hands, the dealer wins.

A player hand is declared the winner if the player high hand and the player low hand outrank 64 the dealer high hand and dealer low hand. A winning player hand is rewarded 64, optionally at even money.

A push is declared if one player's component hand outranks the corresponding dealer's component hand while the remaining dealer's component hand outranks or ties the remaining player's component hand. In the event of a push, the player's wager is collected 64. Likewise, if both the dealer's component hands outrank the player's component hands, or if one of the dealer's component hands outranks the player's component hand and the remaining dealer's component hand ties the player's component hand, the player's wager is collected.

While certain embodiments of the present invention have been shown and described it is to be understood that the present invention is subject to many modifications and changes without departing from the spirit and scope of the claims presented herein.

I claim:

1. A method for playing a casino card game for at least one player, the game method using playing cards, comprising:

the player placing (a) a full-hand wager on a first hand or a second hand or (b) a component-hand wager on a single-card component hand of the first hand, a two-card component hand of the first hand, or both a single-card component hand and two-card component hand of the first hand or (c) both a full-hand wager on a first hand and a component-hand wager on a single-card component hand of the first hand, a two-card component hand of the first hand, or both a single-card component hand and two-card component hand of the first hand;

a dealer dealing three cards to a first hand and three cards to a second hand;

arranging each of said first hand and second hand into a two-card component hand and a single-card component hand;

comparing the first two-card hand to the second two-card hand and the first single-card hand to the second single-card hand;

rewarding players placing a component-hand wager on a single-card component hand of the first hand if the single-card component hand of the first hand outranks the single-card component hand of the second hand;

rewarding players placing a component-hand wager on a two-card component hand of the first hand if the two-card component hand of the first hand outranks the two-card component hand of the second hand;

declaring a push and returning each player's full-hand wager if the first two-card hand is equal in rank to the second two-card hand and the first single-card hand is equal in rank to the second single-card hand or if one component hand of the first hand outranks the corresponding component hand of the second hand and the remaining component hand of the second hand outranks the corresponding component hand of the first hand;

otherwise, declaring the winning hand to be the hand having a component hand outranking the corresponding component hand of the other hand and a remaining component hand outranking or tying the corresponding hand of the other hand; and rewarding players placing a full-hand wager on the winning hand and collecting full-hand wagers from players wagering on the losing hand.

2. The method of claim 1 further comprising:

after said first hand and second hand are dealt, examining the first hand and the second hand;

if either hand has a predetermined three-card combination, comparing the first hand to the second hand and declaring the winning hand to be the hand having the higher ranking three-card combination, otherwise declaring a push if the first and second hands have three-card combinations of equal rank; and terminating said game without arranging said first hand and second hand into component hands.

3. The method of claim 2 wherein the predetermined three-card combination is a three of a kind.

4. A method for playing a casino card game for at least one player, the game method using playing cards, comprising:

the player placing (a) a full-hand wager on a first hand or a second hand or (b) a component-hand wager on a single-card component hand of the first hand, a two-card component hand of the first hand, or both a single-card component hand and two-card component hand of the first hand or (c) both a full-hand wager on a first hand and a component-hand wager on a single-card component hand of the first hand, a two-card component hand of the first hand, or both a single-card component hand and two-card component hand of the first hand;

a dealer dealing three cards to a first hand and three cards to a second hand;

arranging each hand into a two-card component hand and a single-card component hand;

comparing the first two-card hand to the second two-card hand and the first single-card component hand to the second single-card component hand;

rewarding players placing a component-hand wager on a single-card component hand of the first hand if the single-card component hand of the first hand outranks the single-card component hand of the second hand, returning a component-hand wager on a single-card component hand of the first hand if the single-card component hand of the first hand is of equal rank to the single-card component hand of the second hand, or collecting a component-hand wager on a single-card component hand of the first hand if the single-card component hand of the first hand is outranked by the single-card component hand of the second hand;

rewarding players placing a component-hand wager on a two-card component hand of the first hand if the two-card component hand of the first hand outranks the two-card component hand of the second hand, returning a component-hand wager on a two-card component hand of the first hand if the two-card component hand of the first hand is of equal rank to the two-card component hand of the second hand, or collecting a component-hand wager on a two-card component hand of the first hand if the two-card component hand of the first hand is outranked by the two-card component hand of the second hand;

declaring a push and returning each player's full-hand wager if the first two-card component hand is equal in rank to the second two-card component hand and the first single-card component hand is equal in rank to the second single-card component hand or if one component hand of the first hand outranks the corresponding component hand of the second hand and the other component hand of the second hand outranks the corresponding component hand of the first hand;

otherwise, declaring the winning hand to be the hand having a component hand outranking the corresponding component hand of the other hand and a remaining component hand outranking or tying the corresponding hand of the other hand; and rewarding players placing a full-hand wager on the winning hand and collecting full-hand wagers from players wagering on the losing hand.

5. The method of claim 4 further comprising:

after said first hand and second hand are dealt, examining the first hand and the second hand;

if either said first hand or said second hand has three of a kind, comparing the first hand to the second hand and declaring the winning hand to be the hand having the higher ranking three of a kind and rewarding all full-hand wagers and component-hand wagers on said winning hand, otherwise declaring a push if the first and second hands have three of a kinds of equal rank; and terminating said game without arranging said first hand and second hand into component hands.

* * * * *